US005160024A

United States Patent [19]

Evers

[11] Patent Number: 5,160,024

[45] Date of Patent: Nov. 3, 1992

[54] CIGARETTE BOX WITH ATTACHED COUPON

[75] Inventor: Donald H. Evers, Richmond, Va.

[73] Assignee: Philip Morris Incorporated, New York, N.Y.

[21] Appl. No.: 766,048

[22] Filed: Sep. 26, 1991

Related U.S. Application Data

[63] Continuation-in-part of Ser. No. 576,776, Sep. 4, 1990, abandoned.

[51] Int. Cl.[5] ..... B65D 85/10

[52] U.S. Cl. ..... 206/268; 206/264; 206/271; 206/831

[58] Field of Search ..... 206/264, 265, 268, 270, 206/271, 273, 275, 831

[56] References Cited

U.S. PATENT DOCUMENTS

| | | | |
|---|---|---|---|
| 348,924 | 9/1886 | Munson . | |
| 476,765 | 6/1892 | Knapp | 40/313 |
| 727,600 | 5/1903 | Doscher . | |
| 1,116,043 | 11/1914 | Elliott | 206/831 |
| 2,194,168 | 3/1940 | Klein | 206/273 |
| 2,265,664 | 12/1941 | Markert . | |
| 2,359,679 | 10/1944 | Roehrl . | |
| 2,415,117 | 2/1947 | Tamarin | 206/273 |
| 2,803,394 | 8/1957 | Ringler | 229/44 |
| 2,824,684 | 2/1958 | Ahlers | 229/44 |
| 2,889,100 | 6/1959 | Baker | 206/268 |
| 3,018,878 | 1/1962 | Watkins | 206/412 |
| 3,062,430 | 11/1962 | Rutledge | 206/459 |
| 3,102,675 | 9/1963 | Schrom | 229/20 |
| 3,219,253 | 11/1965 | Davis . | |
| 3,606,135 | 9/1971 | Rosenburg, Jr. . | |
| 3,625,412 | 12/1971 | Rosenburg, Jr. . | |
| 3,695,422 | 10/1972 | Tripodi | 206/831 |
| 3,924,740 | 12/1975 | Wood . | |
| 3,958,744 | 5/1976 | Herglotz | 206/831 X |
| 4,042,110 | 8/1977 | Guernsey | 206/459 |
| 4,103,820 | 8/1978 | Mathison et al. . | |
| 4,108,350 | 8/1978 | Forbes, Jr. | 206/459 |
| 4,216,898 | 8/1980 | Davies . | |
| 4,300,676 | 11/1981 | Focke et al. | 206/264 |
| 4,303,155 | 12/1981 | Focke et al. | 206/264 |
| 4,485,926 | 12/1984 | Lenzmeier . | |
| 4,732,276 | 3/1988 | Knecht . | |
| 4,742,955 | 5/1988 | Focke et al. | 229/123 |
| 4,753,383 | 6/1988 | Focke et al. | 229/160.1 |
| 4,753,384 | 6/1988 | Focke et al. | 229/160.1 |
| 4,771,882 | 9/1988 | Lowe et al. | 206/268 |
| 4,779,733 | 10/1988 | Kilian | 206/459 |
| 4,834,240 | 5/1989 | Dagostine | 206/459 |
| 4,850,482 | 7/1989 | Campbell | 206/273 |
| 4,872,555 | 10/1989 | Shadrach, III et al. | 206/459 |
| 4,942,941 | 8/1990 | Focke et al. | 206/254 |
| 4,949,841 | 8/1990 | Focke et al. | 206/254 |
| 5,014,906 | 5/1991 | Gero | 229/123 |

FOREIGN PATENT DOCUMENTS

| | | | |
|---|---|---|---|
| 2047860 | 4/1971 | Fed. Rep. of Germany | 206/831 |
| 2551427 | 5/1977 | Fed. Rep. of Germany . | |
| 2303720 | 10/1976 | France . | |

*Primary Examiner*—Bryon P. Gehman

*Attorney, Agent, or Firm*—Robert R. Jackson; Karen G. Horowitz

[57] ABSTRACT

A box-like cigarette pack has an outer member front wall which initially extends upward toward the top of the cigarettes within the pack. This extension may then continue over the top of the cigarettes in the pack. The outer member front wall is optionally weakened along the line which defines the standard location of the top of the outer member front wall. When the consumer first opens the pack, he or she can remove the extension by tearing or separating along this line of weakening. Thereafter, the pack is like a normal pack. Additional information can be printed on the extension or extensions of the outer member front wall. If provided, the portion which initially extends over the cigarette tops is a convenient size for use as a coupon or the like.

32 Claims, 4 Drawing Sheets

XXX
50
51
YYY
52
53
222
21
20
19
242
27
28a
28
28b
221
29
112
241
224
25
244
23
26
32
226
246
26a
37
35
31
30
30a
30b
116
228
33
19a
21a
248
20a
39
20b

CIGARETTE BOX WITH ATTACHED COUPON

This is a continuation-in-part of patent application Ser. No. 576,776, filed on Sep. 4, 1990, now abandoned.

BACKGROUND OF THE INVENTION

This invention relates to cigarette packs, and more particularly to cigarette packs in the form of boxes.

Cigarette packs in the form of boxes are extremely well known. One of the most popular forms of such boxes has a semi-rigid (e.g., cardboard or paperboard) outer member which includes a lower main portion in which the cigarettes stand vertically. The upper portion is a preferably cardboard lid which is often (although not always) hinged to the back of the main portion so that the upper ends of the cigarettes are exposed when the lid is tipped back. Such boxes typically have a semi-rigid (e.g., cardboard or paperboard) innerframe inside the main portion and which extends up from the main portion under the lid to provide some interference with the lid as it opens and closes. This interference helps to keep the lid firmly and neatly closed and reduces the risk that the lid will open accidentally. The cigarettes may be wrapped in aluminum foil inside the outer member and the innerframe.

Cigarette packs of the foregoing type are relatively small and strong. The visible exterior surfaces are needed for brand-identifying information, contents specifications, warning labels, etc. There is therefore virtually no room on the outside of the pack for additional information such as promotional coupons, and even if such additional information could be put on the outside of the pack, it would be difficult for the consumer to free that information (such as a coupon) from the pack. Placing coupons or other information separately in the pack is disadvantageous because it necessitates additional processing steps and production equipment, because it may not be noticed by the consumer, etc.

It is therefore an object of this invention to provide a cigarette pack having additional surface areas which can be used for a coupon or other information.

It is another object of this invention to provide a cigarette pack including additional information area which cannot be overlooked by the consumer, but which can be easily removed and either saved or discarded as desired.

It is still another object of this invention to provide a cigarette pack having an additional but removable information area, which pack functions as a standard pack after the additional information area is removed.

SUMMARY OF THE INVENTION

These and other objects of the invention are accomplished in accordance with the principles of the invention by providing a box-like, stiff cigarette pack in which the stiff outer member (which may otherwise be substantially conventional) has an extension above the normal front wall. This extension preferably (but not necessarily) continues up to and over the tops of the cigarettes in the box when the lid is first opened. (A conventional innerframe may be provided inside the outer member, and the cigarettes may be wrapped in foil inside the innerframe in the conventional manner). The extension is joined to the outer member front wall along a line which is deliberately weakened to facilitate removal of the extension by tearing or separating along this line. Any desired information can be printed anywhere on either or both sides of this extension. Because in general the consumer cannot conveniently withdraw the first cigarette until this extension (and any underlying foil) has been removed, the consumer cannot fail to see the information on the extension. The extension or any portion of it makes an excellent coupon because it is relatively stiff cardboard or paperboard. Any portion of the extension which initially covers the upper ends of the cigarettes can be easily made rectangular, which is a convenient shape for a coupon. Alternatively, the "coupon" portion of the extension may have any of a wide variety of other shapes. A second (preferably stronger) line of weakness may be provided in the extension to facilitate separation of any "coupon" portion from the remainder of the extension. As still another alternative, the extension may remain in the pack as a dust cover for the cigarettes.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
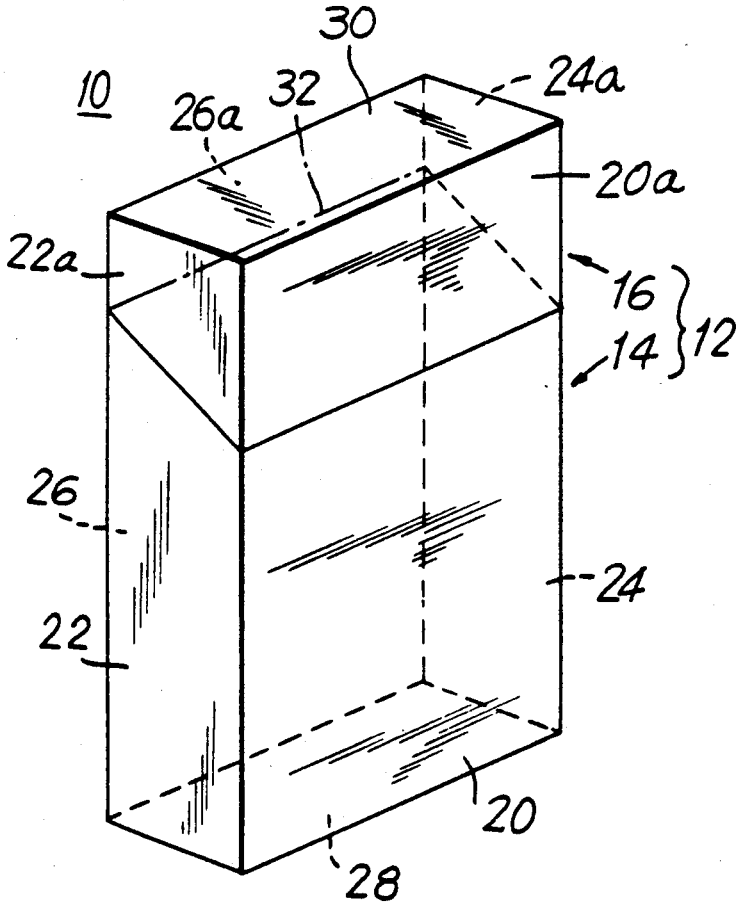
FIG. 1 is an isometric view of a cigarette pack of an illustrative type with which this invention can be employed.

As shown in FIG. 1, the conventional hinged-lid, box-type cigarette pack 10 includes an outer member 12 formed of a substantially stiff material, such as 0.010–0.014 inch thick paperboard or cardboard, preferably 0.012 inch thick paperboard or cardboard. Outer member 12 has a lower main portion 14 and an upper lid portion 16. Main portion 14 has a front wall 20, a left side wall 22, a right side wall 24, a rear wall 26, and a bottom wall 28. Front wall 20 is typically shorter than rear wall 26. Lid 16 has similar front **20*a*, left side 22*a*, right side 24*a*, and rear 26*a* walls which respectively correspond to and function as continuations of the similarly named main portion walls when the lid is closed as shown in FIG. 1. In addition, lid 16 has a top wall 30. Lid 16 is typically hinged to main portion 14 along hinge line 32 where rear walls 26 and 26*a* meet one another. When lid 16 is tipped all the way back along hinge line 32, the pack has the appearance shown in FIG. 2 when viewed from the front, or as shown in FIG. 3** when viewed from the top.

Figure 2:
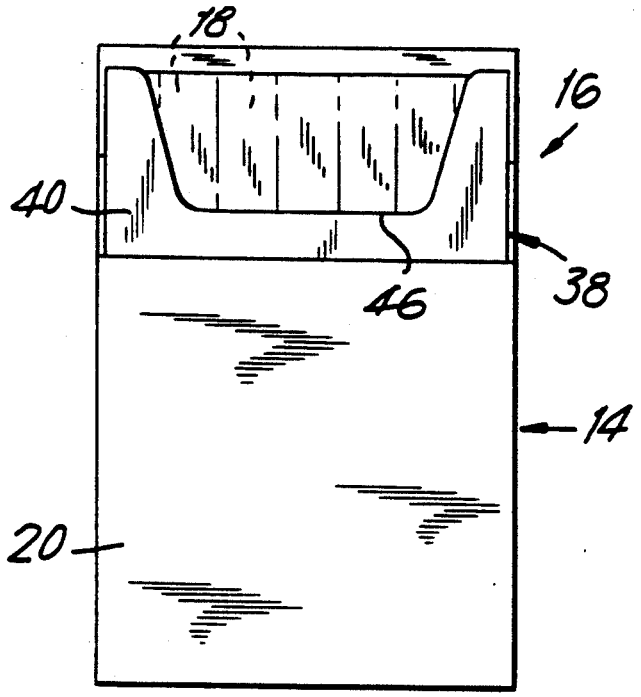
FIG. 2 is a front view of the pack of FIG. 1 with the top or lid pivoted back.
Figure 3:
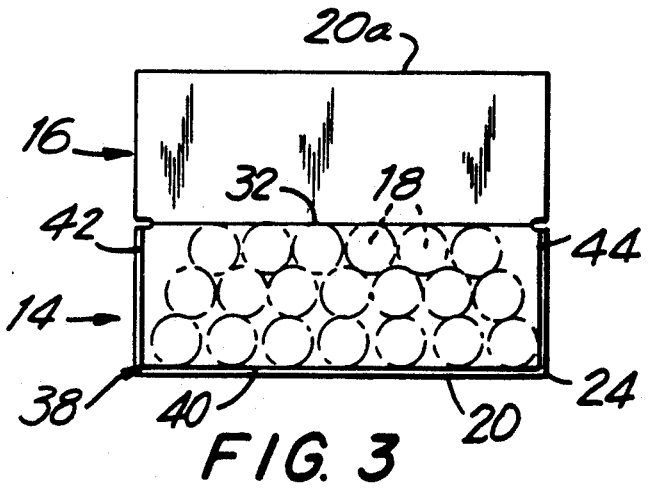
FIG. 3 is a top view of the pack of FIG. 1 with the top or lid pivoted back.

FIGS. 2 and 3 reveal semi-rigid innerframe 38 which is conventionally included inside at least the upper portion of main portion 14. Innerframe 38 is also typically formed of a substantially stiff material such as 0.010–0.014 inch thick paperboard or cardboard, preferably 0.012 inch thick paperboard or cardboard. Innerframe 38 includes a front wall 40, a left side wall 42, and a right side wall 44. Innerframe 38 is positioned in contact with lower main portion 14 and is typically glued to lower main portion 14 to secure the innerframe in place. The central upper portion of innerframe front wall 40 has a cutout 46 to facilitate consumer access to the upper ends of the cigarettes 18 in the pack.

An upper portion of each of innerframe front wall 40, left side wall 42, and right side wall 44 projects above lower main portion 14 and remains unattached to any other portion of the cigarette pack outside the innerframe. When lid 16 is closed, it fits down over and completely covers the portion of innerframe 38 which projects above main portion 14, remaining adjacent yet unattached to the innerframe. Innerframe 38 is of substantially the same stiffness as lid 16 such that it interferes somewhat with lid 16 as the lid is opened and closed. This interference helps to keep lid 16 neatly closed and reduces the risk of the pack opening by accident. Retention cuts (not shown, but well known in the art, as shown, for example, by U.S. Pat. No. 4,216,898) may also be included on innerframe 38 to provide additional interference.

Typically, cigarettes 18 are initially wrapped in a relatively thin and flexible metal (e.g., aluminum) foil bundle (not shown in detail) inside innerframe 38. Such a foil wrapper, when intact, serves to contain the cigarettes through the packing process, to protect the cigarettes, to provide an oil barrier between the cigarettes and the innerframe and outer member, and to retain moisture in the cigarettes. The upper front portion of this foil wrapper may be removed by the consumer when he or she opens the pack to expose the cigarette ends.

Figure 4:
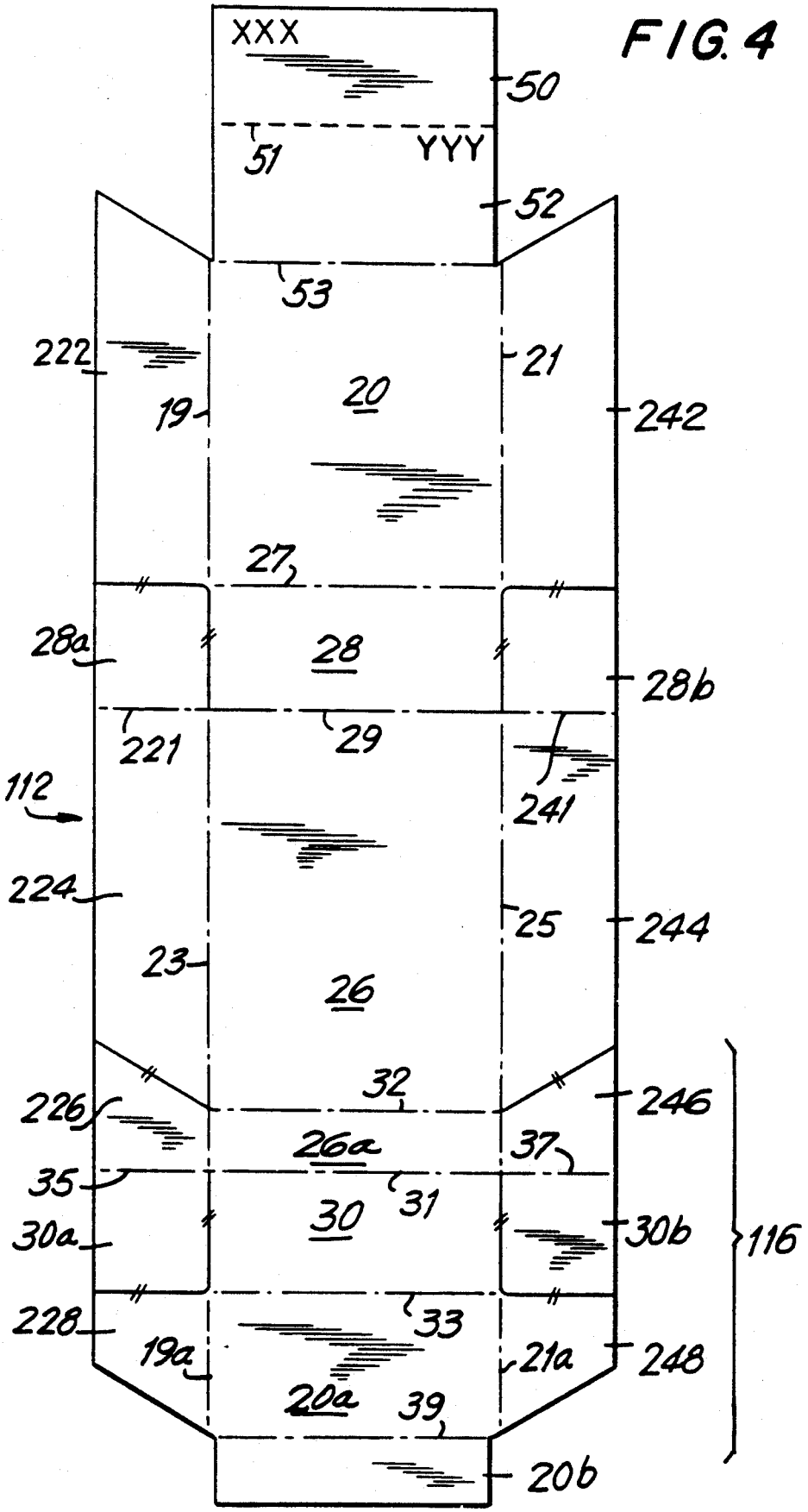
FIG. 4 is a plan view of an illustrative outer member blank configured in accordance with this invention.

An illustrative semi-rigid outer member blank 112 in accordance with this invention is shown in FIG. 4, in which double transverse lines on a panel boundary indicate a boundary which has been completely cut through. Similar reference numbers are used in FIGS. 4–6 for elements which are similar or related to outer member elements described above.

Outer member blank 112 is preferably formed of a substantially stiff material such as 0.010–0.014 inch thick (preferably 0.012 inch thick) paperboard or cardboard. Blank 112 includes a front wall panel 20 which is extended upwardly (above line 53) to include an extended front wall panel 52 and optionally a top wall panel 50 (separated from panel 52 by line 51). Rear wall panel 26 is joined to lid member blank portion 116 along hinge line 32. The front wall **20*a* of the lid member may include an extended fold panel 20*b* to be folded 180° along fold line 39 so that fold panel 20*b* lies substantially flat along the inside of front wall 20*a* of the lid member. It may, however, be desirable to omit fold panel 20*b* to minimize board thickness build up and potential pack construction problems, and also to reduce board requirements. An alternative solution would be to deboss innerframe 38, which would similarly permit additional room for panels 50 and 52**.

Outer member left side wall 22 is formed from outer member blank left side panels 222 and 224 which are folded one over the other. Outer member right side wall 24 is similarly formed from outer member blank right side panels 242 and 244. Tabs **28*a* and 28*b* rest above bottom wall 28 when the outer member blank side panels are folded one over the other. In a similar fashion, lid member left side wall 22*a* is formed from two pieces, namely, lid member blank left side panels 226 and 228; and lid member right side wall 24*a* is formed from two pieces, namely, lid member blank right side panels 246 and 248. Tabs 30*a* and 30*b* rest under lid member top wall 30 when lid member side walls are folded one over the other. Panels 50 and 52 are also inside, but preferably not attached to, the lid member when the blank is formed into a box. In other words, in the finished box, panels 50 and 52 are preferably not attached to anything other than panel 20 via the connection at line 53**.

Lines **19, 21, 23, 25, 27, 29, 31, 32, 33, 35, 37, 39, 19*a*, 21*a*, 221, and 241 are weakened (e.g., scored) to facilitate folding of their related panels/walls. Blank 112 is also preferably weakened (e.g., by extensive nicks, perforations, or cut scores) along line 53. As will be described in more detail below, this helps the consumer remove panels 50 and 52 when he or she first opens the pack (if such removal is intended). Blank 112 is also preferably weakened (e.g., by scoring or any of the techniques mentioned above) along line 51 at least to facilitate folding panel 50 back toward the rear of the pack over the top of the cigarettes as the pack is made up. In addition, this weakening along line 51 may be such as to facilitate consumer separation of panels 50 and 52 (e.g., so that panels 50 and 52 may have different matter printed thereon and can be saved separately). If only folding along line 51 is desired (e.g., because there is no "coupon" or because panels 50 and 52 together comprise the "coupon"), then the blank may be merely scored along that line. On the other hand, if panel separation along line 51 is desired, then cuts and/or perforations may be used along line 51. In any event, the weakening of blank 112 along line 51 is preferably less than the weakening along line 53 so that panels 50 and 52 tend to come out of the pack together. For example, line 51 can be perforated or scored and line 53 can be nicked. Thereafter, panels 50 and 52 can be separated along line 51** if desired.

Figure 5:
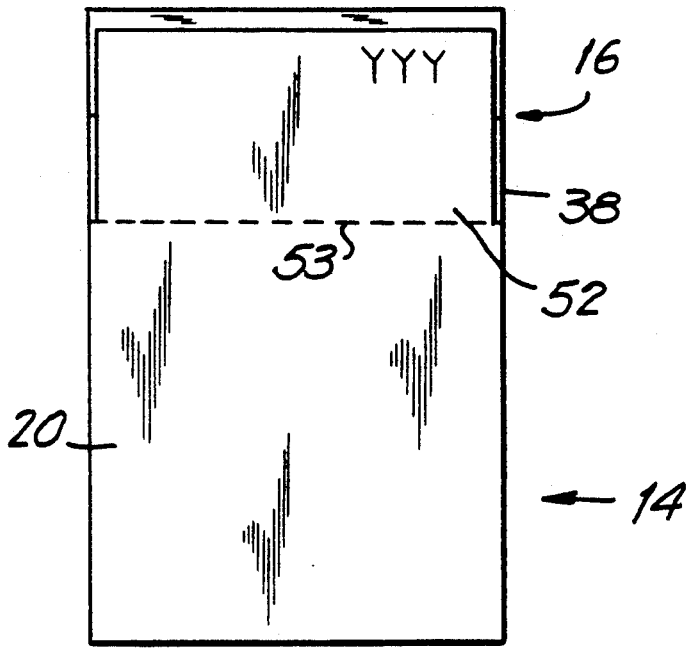
FIG. 5 is a view similar to FIG. 2 but showing a pack having an outer member of the type shown in FIG. 4.
Figure 6:
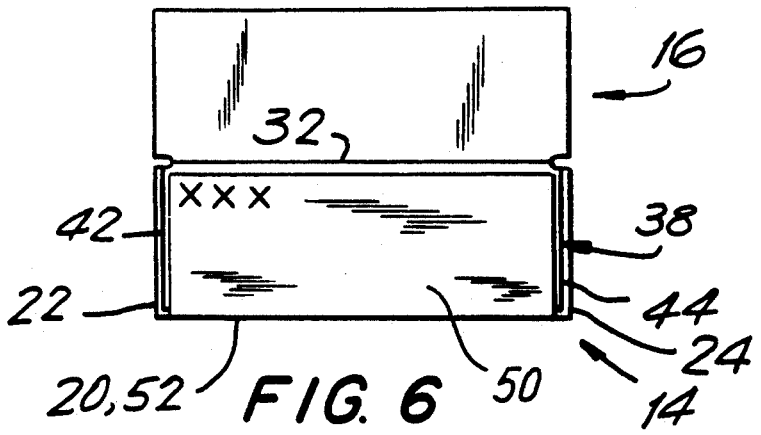
FIG. 6 is a view similar to FIG. 3 but showing a pack having an outer member of the type shown in FIG. 4.

As suggested by the letters XXX and YYY in FIGS. 4–6, either or both of panels 50 and 52 may be provided (through any known means such as printing, embossing, outlining with a special die cut, or providing with a die cut hole) on either or both sides with any desired information. For example, panel 50 may be printed with coupon or promotional information, while panel 52 may be printed with a suggestion that panel 50 be torn off and saved. The back side of any coupon portion to be saved may be printed with the required dealer copy. Such information may be placed on the outer member at the same time that information is placed on the other portions of the blank, which may be before or after the outer members are cut to their final individual shape. A special eye mark may be included on either or both sides of the blank in printing applied prior to cutting to help register the cutting with the printing. If the information is not printed, but rather is provided by means of a die cut, the unique shape imparted to the panel or panels may be used for various promotional or advertising purposes.

FIGS. 5 and 6 are respectively similar to FIGS. 2 and 3, respectively, but show a cigarette pack with outer member 112 prior to removal of panels 50 and 52. As can be seen in FIGS. 5 and 6, panels 50 and 52 extend up from front wall 20. Panel 50 extends over the top of the cigarettes in the pack. Panels 50 and 52 are free from any attachment other than to panel 20 along line 53. Except for the addition of panels 50 and 52, the pack shown in FIGS. 5 and 6 may be exactly as described above in connection with FIGS. 1–3. In particular, the innerframe of the pack shown in FIGS. 5 and 6 can be exactly the same as the innerframe 38 shown in FIGS. 2 and 3 and described in detail above, and the cigarettes may be wrapped in foil inside the inner frame as described above. The innerframe of the pack shown in FIGS. 5 and 6 can alternatively be of the same configuration as the innerframe disclosed in co-pending, commonly assigned patent application Ser. No. 576,776, filed Sep. 4, 1990, or the innerframe disclosed in co-pending, commonly assigned patent application Ser. No. 659,712, filed Feb. 25, 1991. Innerframe panels 42 and 44 are respectively inside and extend up from left and right side walls 22 and 24.

Although FIGS. 5 and 6 show the pack with top 16 open, it will be appreciated that the top opens and closes exactly as shown in FIGS. 1–3 and described above. As in the prior art, when the top of the pack shown in FIGS. 5 and 6 is closed, the outer member of the pack completely encloses and obscures innerframe 38 and panels 50 and 52 without lid 16 being attached to panel 50 or 52 or to innerframe 38. Accordingly, when the pack shown in FIGS. 5 and 6 is closed, it looks exactly as shown in FIG. 1.

When the consumer of a pack having an outer member of the type shown in FIG. 4 first opens the pack, he or she sees what is shown in FIGS. 5 and 6. In order to conveniently remove a cigarette from the pack, the consumer must first remove cardboard panels 50 and 52. This is both readily apparent to the consumer from, and facilitated by, the visible weakening along line 53. The printing on panel 50 or 52 may also or alternatively, suggest removal of these panels. After panels 50 and 52 have been removed, the pack more closely resembles the pack shown in FIGS. 2 and 3 and is thereafter substantially the same as a conventional pack. Also after removal from the pack, panels 50 and 52 can be separated from one another (e.g., so that one panel can be saved, while the other panel is discarded as described above), or panels 50 and 52 may remain together for discard or retention as a unit. Because panels 50 and 52 are cardboard (or other similar, substantially stiff material), they make an excellent coupon.

Although panels 50 and 52 are shown as rectangles, it will be appreciated that either can have other shapes such as a scalloped edge, an oval, etc. Also, if less copy area is required, panel 50 can be eliminated entirely.

Although panels 50 and 52 are described as being suitable for containing additional printed information, because they more completely cover the upper ends of the cigarettes, they may alternatively or in addition be used as a substitute for foil wrapping of the cigarettes. Also, if instead of being adapted for immediate removal, panels 50 and 52 are more securely joined to the remainder of the pack (e.g., by a score line 53 rather than a perforated line), panels 50 and 52 can remain at least temporarily in the pack and act as a dust cover which is folded forwardly when a cigarette is to be removed and then folded back when the lid is to be closed again.

It will be understood that the foregoing is merely illustrative of the principles of the invention, and that various modifications can be made by those skilled in the art without departing from the scope and spirit of the invention. For example, lid 16 may be either integral with main portion 14 or glued to main portion 14 by a tab. The lid of the pack may also slide on and off over the innerframe rather than pivoting open and closed. It will also be appreciated that the principles of this invention can be applied to cigarette packs of any size (e.g., packs of 10, 14, 20 (as shown in the drawings), 25, etc., cigarettes).

What is claimed is:

1. A cigarette pack adapted to contain a plurality of cigarettes, said cigarette pack comprising:

a box-shaped outer member with four substantially vertical walls and a bottom wall, wherein said substantially vertical walls include an outer member front wall having first and second substantially vertical edges on each side thereof, a first substantially horizontal top edge along the top thereof, and a first substantially horizontal bottom edge along the bottom thereof; an outer member rear wall substantially parallel to and spaced form said outer member front wall, said outer member rear wall having third and fourth substantially vertical edges on each side thereof, a second substantially horizontal top edge along the top thereof, and a second substantially horizontal bottom edge along the bottom thereof, wherein said third substantially vertical edge is spaced form and juxtaposed to said first substantially vertical edge and said fourth substantially vertical edge is spaced from and juxtaposed to said second substantially vertical edge; an outer member first side wall extending between said first and third juxtaposed substantially vertical edges; an outer member second side wall extending between said second and fourth juxtaposed substantially vertical edges; and a bottom wall extending between said first and second substantially horizontal bottom edge; and a first panel connected to said outer member front wall along said first substantially horizontal top edge and having a first top edge, said first panel being free from attachment to any part of said pack other than to said outer member front wall along said substantially horizontal top edge;

wherein said first top edge of said first panel is at most as high as said second substantially horizontal top edge of said outer member rear wall and said first panel lies in coplanar or a substantially parallel plane as said outer member front wall in said cigarette pack.

2. The cigarette pack defined in claim 1 wherein said first panel is printed with predetermined indicia.

3. The cigarette pack defined in claim 1 wherein said first panel is connected to said outer member front wall along a first weakened line formed along said first substantially horizontal top edge of said outer member front wall so that said first panel can be easily torn out of the pack for complete removal from the pack.

4. The cigarette pack defined in claim 3 wherein said first weakened line is constituted by a line of perforations.

5. The cigarette pack defined in claim 3 wherein said first weakened line is constituted by a series of nicks.

6. The cigarette pack defined in claim 3 wherein said first weakened line is constituted by a score line.

7. The cigarette pack defined in claim 1 further including a second panel connected to and extending from said first top edge of said first panel toward said outer member rear wall, wherein said second panel is free from attachment to any part of said pack other than to said first panel along said first top edge of said first panel.

8. The cigarette pack defined in claim 7 wherein said outer member, said first panel and said second panel are formed from a single blank.

9. The cigarette pack defined in claim 7 wherein said second panel overlies the upper ends of the cigarettes in the pack.

10. The cigarette pack defined in claim 7 wherein at least one of said first panel and said second panel is printed with predetermined indicia.

11. The cigarette pack defined in claim 7 wherein said first panel is connected to said outer member front wall along a first weakened line formed along said first substantially horizontal top edge of said outer member front wall so that said first panel can be easily torn out of the pack for complete removal from the pack.

12. The cigarette pack defined in claim 11 wherein a second weakened line is formed along said first top edge of said first panel to facilitate separation of said first panel from said second panel.

13. The cigarette pack defined in claim 12 wherein said first weakened line is weakened to a greater extent than said second weakened line.

14. The cigarette pack defined in claim 13 wherein said first and second weakened lines are constituted by perforated lines and wherein the extent of weakening is determined by varying the size of the perforations.

15. The cigarette pack defined in claim 14 wherein said first weakened line is constituted by a series of cuts and said second weakened line is constituted by a line of perforations such that said first weakened line is weakened to a greater extent than said second weakened line.

16. The cigarette pack defined in claim 13 wherein said first weakened line is constituted by a series of nicks and said second weakened line is constituted by a score line such that said first weakened line is weakened to a greater extent than said second weakened line.

17. The cigarette pack defined in claim 1 further comprising:

a lid member adapted to rest above said outer member, said lid member having four substantially vertical walls and a top wall, wherein said substantially vertical walls include a lid member front wall corresponding to said outer member front wall; a lid member rear wall corresponding to said outer member rear wall; a lid member first side wall corresponding to said outer member first side wall; a lid member second side wall corresponding to said outer member second side wall; and a lid member top wall; wherein each said lid member wall having a corresponding outer member wall functions as a continuation of said corresponding outer member wall when the lid is resting above said outer member, such that the combined height of each of said outer member walls with its corresponding lid member wall is substantially the height of a cigarette.

18. The cigarette pack defined in claim 17 wherein said outer member front wall is shorter than said outer member rear wall and said lid member rear wall is shorter than said lid member front wall.

19. The cigarette pack defined in claim 18 wherein said lid member is hinged to said outer member rear wall.

20. The cigarette pack defined in claim 18 wherein the height of said first panel is substantially equal to the height of said lid member front wall.

21. The cigarette pack defined in claim 18 further including a second panel connected to and extending from said first top edge of said first panel toward said outer member rear wall.

22. The cigarette pack defined in claim 21 wherein said outer member, said lid member, said first panel and said second panel are formed from a single blank.

23. The cigarette pack defined in claim 21 wherein said single blank is formed from paperboard.

24. The cigarette pack defined in claim 23 wherein said paperboard is between 0.010 inches and 0.014 inches thick.

25. The cigarette pack defined in claim 17 wherein said lid member front wall has a fourth substantially horizontal bottom edge, said lid member front wall further comprising a lid extension member connected to and extending from said fourth substantially horizontal bottom edge.

26. The cigarette pack defined in claim 25 wherein said lid extension member is folded 180 degrees along said fourth substantially horizontal bottom edge so that it lies substantially flat adjacent the inner face of said lid member front wall.

27. The cigarette pack defined in claim 17 further comprising:

an innerframe member of substantially the same stiffness as said outer member and positioned partly inside at least an upper portion of said outer member, said innerframe member including an innerframe front wall adjacent to said upper member front wall and having fifth and sixth substantially vertical edges along each side thereof, a second top edge along the top thereof, and a third substantially horizontal bottom edge along the bottom thereof; an innerframe first side wall extending from said fifth substantially vertical edge toward said outer member rear wall; and an innerframe second side wall extending from said sixth substantially vertical edge toward said outer member rear wall; wherein said innerframe front wall extends up from inside said outer member front wall such that said second top edge is above said first substantially horizontal top edge and said third substantially horizontal bottom edge is below said first substantially horizontal top edge.

28. The cigarette pack defined in claim 27 wherein the central upper portion of said innerframe front wall has a cutout to facilitate consumer access to the upper ends of the cigarettes in the pack.

29. The cigarette pack defined in claim 27 wherein said lid member fits over and completely covers the portion of said innerframe member which projects above said outer member to close the pack.

30. The cigarette pack defined in claim 29 wherein said innerframe member is not attached to said lid member yet interferes somewhat with the opening of said lid member to keep said lid member neatly closed and to reduce the risk of the pack opening by accident.

31. The cigarette pack defined in claim 1 wherein said outer member is substantially semi-rigid.

32. The cigarette pack defined in claim 31 wherein said first panel is substantially semi-rigid.

* * * * *